US010375468B2

(12) United States Patent
Spillmann et al.

(10) Patent No.: US 10,375,468 B2
(45) Date of Patent: Aug. 6, 2019

(54) RIGGING SYSTEM FOR SPEAKERS

(71) Applicant: HARMAN INTERNATIONAL INDUSTRIES, INC., Stamford, CT (US)

(72) Inventors: Jacques Spillmann, Los Angeles, CA (US); Derrick Rodgers, Altadena, CA (US); Lawrence Romestant, Northridge, CA (US)

(73) Assignee: HARMAN INTERNATIONAL INDUSTRIES, INCORPORATED, Stamford, CT (US)

( * ) Notice: Subject to any disclaimer, the term of this patent is extended or adjusted under 35 U.S.C. 154(b) by 899 days.

(21) Appl. No.: 14/158,375

(22) Filed: Jan. 17, 2014

(65) Prior Publication Data

US 2014/0205132 A1 Jul. 24, 2014

Related U.S. Application Data

(60) Provisional application No. 61/754,167, filed on Jan. 18, 2013.

(51) Int. Cl.

| | |
|---|---|
| ***H04R 25/00*** | (2006.01) |
| ***H04R 1/18*** | (2006.01) |
| ***H04R 1/02*** | (2006.01) |
| ***H04R 1/32*** | (2006.01) |
| ***H04R 1/40*** | (2006.01) |

(52) U.S. Cl.

CPC ..... *H04R 1/18* (2013.01); *H04R 1/026* (2013.01); *H04R 1/323* (2013.01); *H04R 1/403* (2013.01)

(58) Field of Classification Search

CPC ..... H04R 1/026; H04R 1/403; H04R 27/00; H04R 1/02; H04R 1/26; H04R 1/30; H04R 1/323; H04R 1/025; H04R 2201/401; H04R 1/028; H04R 1/18; H04R 2201/025; H04R 2201/403; H04R 2499/13

USPC ..... 381/386, 387, 395, 388, 87, 332, 333, 381/335, 334; 181/199

See application file for complete search history.

(56) References Cited

U.S. PATENT DOCUMENTS

| | | | | |
|---|---|---|---|---|
| 6,640,924 | B2 * | 11/2003 | Messner | 181/144 |
| 7,261,180 | B1 | 8/2007 | Faranda | |
| 7,298,860 | B2 * | 11/2007 | Engebretson et al. | 381/386 |
| 7,328,769 | B1 * | 2/2008 | Adamson | 181/199 |

(Continued)

OTHER PUBLICATIONS

SPEK-TRIX User Manual version 1.0, Adamson Systems Engineering, Copyright, 2009.

(Continued)

*Primary Examiner* — Phylesha Dabney

(74) *Attorney, Agent, or Firm* — Brooks Kushman P.C.

(57) ABSTRACT

A speaker assembly rigging system is provided with a first frame and a second frame that is adapted to couple to the first frame. The system includes a cam and a link. The cam is pivotally connected to the first frame about a pivot point. The cam includes at least two cam surfaces, and each of the at least two cam surfaces are offset at a different radial distance from the pivot point corresponding to a splay angle. The link has a proximal end that is pivotally connected to the second frame and a distal end having a contact surface. The link extends from the second frame in a deployed position such that the contact surface engages one of the cam surfaces.

20 Claims, 8 Drawing Sheets

(56) References Cited

U.S. PATENT DOCUMENTS

| | | | | |
|---|---|---|---|---|
| 8,170,263 | B2 * | 5/2012 | Engebretson et al. | 381/386 |
| 9,516,396 | B2 * | 12/2016 | Andrews | H04R 1/025 |
| 2002/0153195 | A1 * | 10/2002 | Messner | 181/198 |
| 2003/0231782 | A1 * | 12/2003 | Engebretson et al. | 381/182 |
| 2005/0232455 | A1 * | 10/2005 | Monitto et al. | 381/335 |
| 2006/0210095 | A1 * | 9/2006 | Monitto et al. | 381/87 |
| 2009/0022354 | A1 * | 1/2009 | Parker | 381/395 |
| 2011/0305362 | A1 * | 12/2011 | McGhee et al. | 381/386 |
| 2013/0208936 | A1 * | 8/2013 | McGhee et al. | 381/332 |
| 2014/0205126 | A1 * | 7/2014 | Faranda et al. | 381/335 |
| 2014/0205132 | A1 * | 7/2014 | Spillmann et al. | 381/387 |
| 2014/0307907 | A1 * | 10/2014 | Takeuchi et al. | 381/334 |

OTHER PUBLICATIONS

NEXO S.A.—GEO T Series User Manual V1.05, May 10, 2010.
Extended European Search Report dated Jun. 3, 2015 for EP14151524.7.

* cited by examiner

RIGGING SYSTEM FOR SPEAKERS

CROSS-REFERENCE TO RELATED APPLICATIONS

This application claims the benefit of U.S. provisional application Ser. No. 61/754,167 filed Jan. 18, 2013, the disclosure of which is hereby incorporated in its entirety by reference herein.

TECHNICAL FIELD

One or more embodiments relates to a rigging system for a line array of speakers having a cam for adjusting a splay angle between adjacent speakers.

BACKGROUND

A line array of speakers is a group of often similarly sized speakers positioned adjacent to one another to optimize a sound level output over a larger coverage area. Line array speaker systems are often used in large venues, such as auditoriums and concert halls, where high sound level is projected over a wide coverage area. Line array speakers provide increased directivity at various frequencies. Providing increased directivity at various frequencies extends the near-field coverage area because the coverage distance from the near field to the far field transition zone is increased with frequency. The ability of line array speaker systems to increase near field extension is known. For this reason, line arrays offer significant advantages over traditional multi-box sound systems and are often used for large venues.

To achieve a desired sound level over a desired coverage area, line arrays are strategically positioned in various places, at varying heights and angles, throughout a venue. The positioning of the line arrays is determined using equations that anticipate the performance of differently sized speakers based upon their arrangement relative to one another. The specific height of a line array, and the angle and spacing between the speakers in the line array are the main variables that govern the sound level output and coverage area of the line array. The height of an array governs the line array's directivity. The spacing of the individual speakers, which is a second-order effect, determines a lobing structure of the line array. For example, a relatively straight array may radiate the sound level desired for far field coverage. For near field coverage, the line arrays often require some degree of curvature to provide uniformity of coverage over a wider vertical angle.

Once a speaker arrangement for a given venue is determined, the speakers in the line arrays are then typically arranged and mounted on specially designed racks. Depending upon the desired arrangement, the line arrays are then suspended in the air with hanging equipment, which is referred to as a "tension" configuration herein and/or placed on the ground, which is referred to as a "compression" configuration herein. Additionally, support structure (e.g., chains) may be connected to speakers that are hung from the ceiling, such that the corresponding rigging systems are in compression. By arranging the line array speakers and articulating or curving the line array in the vertical plane at a specific splay angle, one can provide excellent coverage for listeners seated in both the near and the far fields.

U.S. Pat. No. 8,170,263 to Engebretson et al. discloses an example of a rigging system for line array speakers and allows for the adjustment of a splay angle between adjacent loudspeakers.

SUMMARY

In one embodiment, a speaker rigging assembly is provided with a frame, a cam and a link. The cam is pivotally connected to the frame about a pivot point. The cam includes at least two cam surfaces, and each of the at least two cam surfaces are offset at a different radial distance from the pivot point corresponding to a splay angle. The cam also includes an intermediate surface between the at least two cam surfaces. The link has a proximal end that is pivotally connected to the frame and a distal end having a contact surface. The link extends from the frame in a deployed position to engage a cam surface of a cam of an adjacent speaker rigging assembly, wherein at least one of the frame and the link are adapted to be mounted to a speaker assembly.

In another embodiment, a speaker array is provided with a first speaker assembly and a second speaker assembly. The first speaker assembly includes a first speaker cabinet having laterally spaced apart first side surfaces. The first speaker assembly also includes a first frame that is mounted to one of the first side surfaces, a first cam that is pivotally connected to the first frame about a first pivot point, and a first link having a first proximal end that is pivotally connected to the first frame and a first distal end having a first contact surface. The second speaker assembly includes a second speaker cabinet having laterally spaced apart second side surfaces. The second speaker assembly also includes a second frame that is mounted to one of the second side surfaces, a second cam and a second link. The second cam is pivotally connected to the second frame about a second pivot point, wherein the second cam has at least two steps formed into a peripheral surface. Each step is formed with an independent cam surface that is offset at a different radial distance from the second pivot point corresponding to a splay angle. The second link has a second proximal end that is pivotally connected to the second frame and a second distal end having a second contact surface that is formed therein. The first link extends from the first frame in a deployed position such that the first contact surface engages one of the steps of the second speaker assembly for orientating the first speaker assembly and the second speaker assembly at a splay angle therebetween corresponding to the step.

In yet another embodiment, a speaker assembly rigging system is provided with a first frame and a second frame that is adapted to couple to the first frame. The system includes a cam and a link. The cam is pivotally connected to the first frame about a pivot point. The cam includes at least two cam surfaces, and each of the at least two cam surfaces are offset at a different radial distance from the pivot point corresponding to a splay angle. The link has a proximal end that is pivotally connected to the second frame and a distal end having a contact surface. The link extends from the second frame in a deployed position such that the contact surface engages one of the cam surfaces.

As such, the speaker rigging assembly, the speaker array and the rigging system each include a cam having a series of steps that are formed as independent cam surfaces, where each step corresponds to a different splay angle. Such a cam provides a large splay angle range in a compact package, and allows for small splay angle increment. Further, when used in a compression configuration, the step engages a corresponding contact surface that is formed in the rear link for distributing the weight of the speaker assemblies over a large bearing surface and without a fastener.

DETAILED DESCRIPTION

As required, detailed embodiments of the present disclosure are disclosed herein; however, it is to be understood that the disclosed embodiments are merely exemplary and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
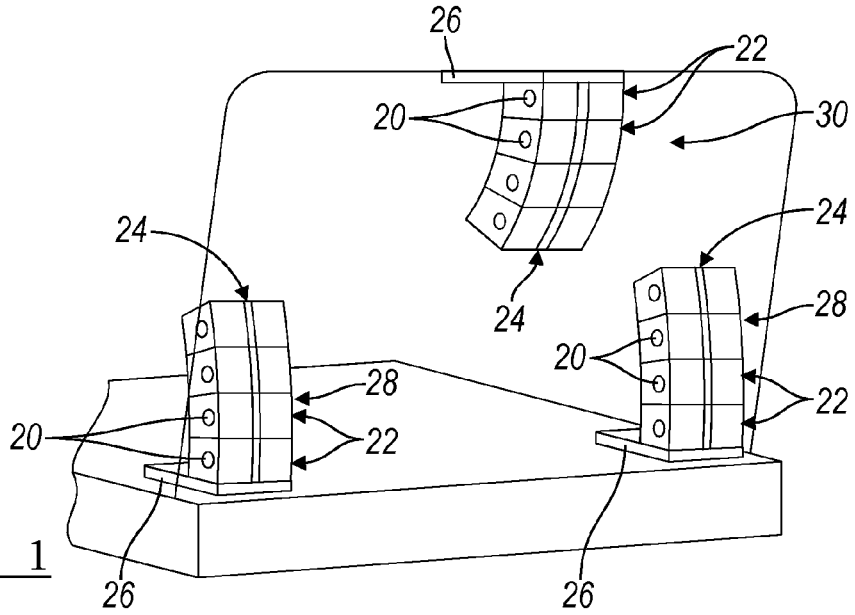
FIG. 1 is a front perspective view of a stage with speaker assemblies arranged in line arrays and orientated in both tension and compression configurations.

With reference to FIG. 1, a rigging system is illustrated in accordance with one or more embodiments and is generally represented by numeral 20. A rigging system 20 is mounted to each speaker assembly 22. The rigging system 20 is used to connect a speaker assembly 22 to a vertically adjacent speaker assembly 22 to form a line array 24 of speaker assemblies. The line arrays 24 are connected to a base 26. The base 26 rests upon an underlying surface (e.g., a stage) in a compression configuration 28, and a line array 24 of speaker assemblies 22 are stacked upon the base 26. In a tension configuration 30, the base 26 is hung from an upper support structure, and the line array 24 is suspended from the base 26.

The terms "compression" and "tension" refer to the direction of forces acting upon the rigging system 20. In one or more embodiment, additional support structure (e.g., chains) may be connected to speaker assemblies 22 that are hung from the ceiling, such that the corresponding rigging systems are in compression (not shown).

The illustrated embodiment depicts line arrays 24 of four speaker assemblies 22. However, other embodiments contemplate line arrays 24 of more than four or less than four speaker assemblies. The number of speaker assemblies 22 in a line array 24 depends on the sound requirements of a venue, the weight of each speaker assembly 22 and the load capacity of each rigging system 20.

Figure 2:
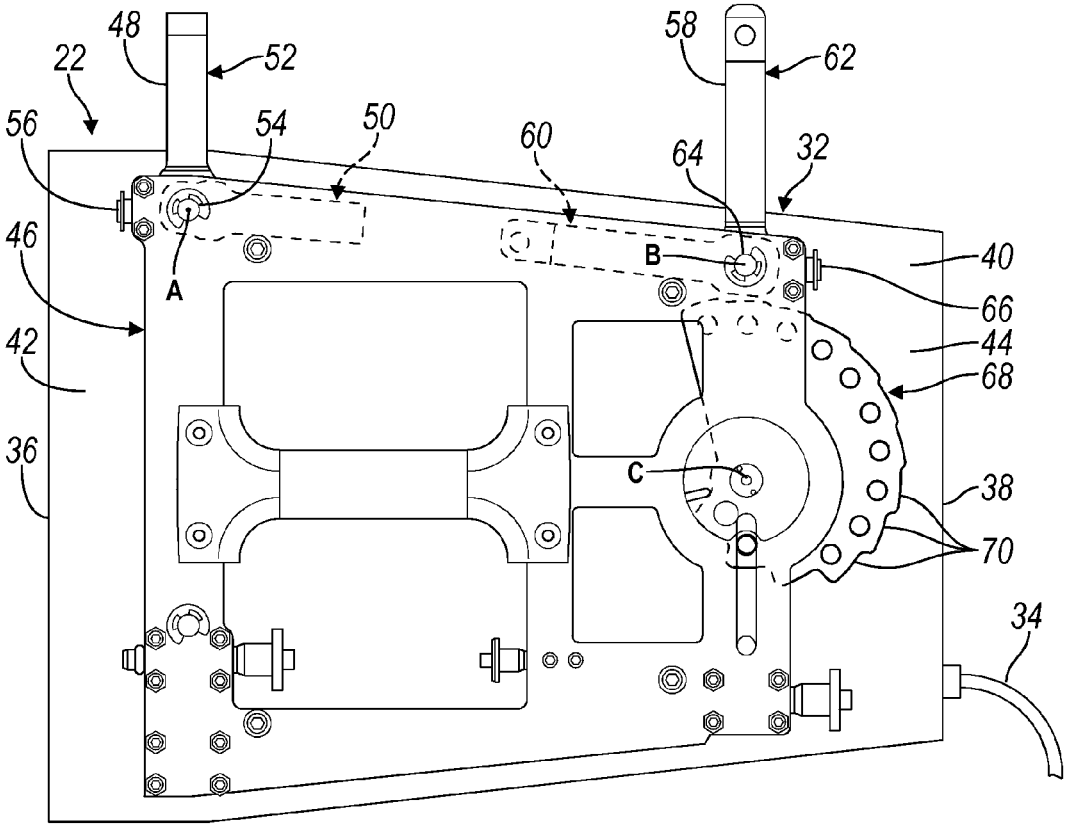
FIG. 2 is an enlarged right side view of a speaker assembly of FIG. 1, according to one or more embodiments.

Referring to FIG. 2, each speaker assembly 22 includes a cabinet 32 for enclosing various speaker components (not shown). A cable 34 extends from the cabinet 32 and connects to a power source (not shown) for receiving electrical power. Additional cables or wires (not shown) extend from the cabinet 32 for receiving audio signals. Alternatively, the speaker assembly 22 may receive audio signals by wireless communication. The cabinet 32 includes a front surface 36, a rear surface 38 and a pair of side surfaces 40 extending between the front and rear surfaces 36, 38. In one embodiment, the cabinet has a front surface 36 with a vertical height of approximately 11 in. (280 mm), a lateral width of approximately 35.5 in. (900 mm), and a side surface 40 with a longitudinal length of approximately 15.8 in. (400 mm). Each speaker assembly weighs approximately 90 lbs (41 kg). Other embodiments contemplate speaker assemblies having different sizes.

Each side surface 40 includes a front end 42 that is adjacent to the front surface 36, and a rear end 44 that is adjacent to the rear surface 38. The front end 42 has a greater vertical height than the rear end 44 such that each side surface 40 is formed in a generally trapezoidal shape. The rigging system 20 includes a frame 46 that is mounted to a side surface 40 of the speaker assembly 22.

The rigging system 20 includes a front link 48 that is pivotally connected to an upper portion of a front end of the frame 46. The front link 48 pivots about axis "A" between a stowed position 50 (shown in dashed line) and a deployed position 52. In the illustrated embodiment, the frame 46 includes a shaft 54 that is oriented along axis A, and an aperture is formed through a proximal end of the front link 48 for receiving the shaft 54. In one or more embodiments, the frame 46 includes a plunger 56 for locking the front link 48 in each of the stowed and deployed positions 50, 52. The plunger 56 is secured to the frame 46 and spring biased to contact the proximal end of the front link 48 for locking it in position.

The rigging system 20 includes a rear link 58 that is pivotally connected to an upper portion of a rear end of the frame 46. The rear link 58 pivots about axis "B" between a stowed position 60 (shown in dashed line) and a deployed position 62. In the illustrated embodiment, the frame 46 includes a shaft 64 that is oriented along axis B, and an aperture is formed through a proximal end of the rear link 58 for receiving the shaft 64. In one or more embodiments, the frame 46 includes a spring biased plunger 66 for locking the rear link 58 in each of the stowed and deployed positions 60, 62, in a similar fashion as that of the plunger 56 for the front link 48.

Figure 3:
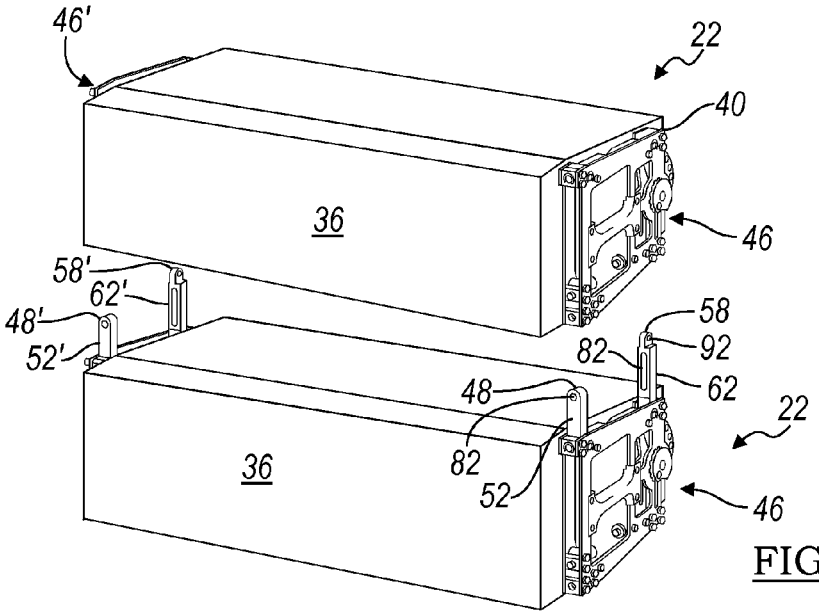
FIG. 3 is a front perspective view of the speaker assembly of FIG. 2, illustrated with a rigging system that is oriented in a stored position and above a second speaker assembly with a rigging system that is oriented in a deployed position.
Figure 4:
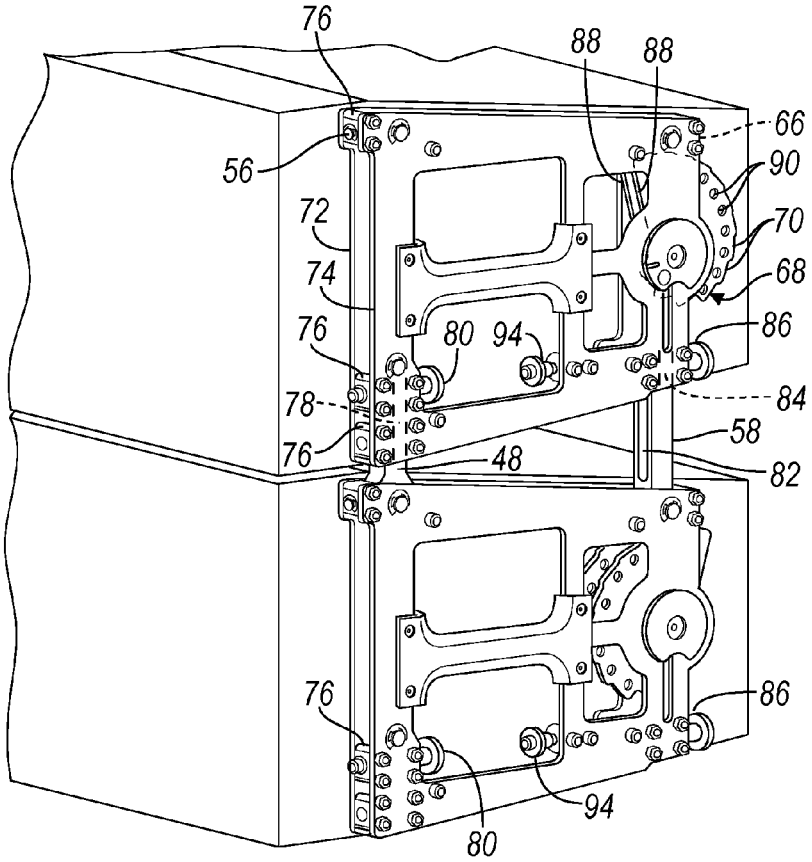
FIG. 4 is a side perspective view of the speaker assemblies of FIG. 3, illustrated connected to each other to form a line array.

The front link 48 and the rear link 58 each extend upward from the frame 46 when oriented in the deployed positions, 52, 62 for connecting to a lower portion of the frame 46 of a vertically adjacent cabinet (shown in FIGS. 3 and 4).

The rigging system 20 includes a cam 68 for adjusting a splay angle between two vertically adjacent speaker assemblies 22. The cam 68 is pivotally connected to an intermediate portion of the frame 46. The cam 68 pivots about axis "C". The cam 68 has an outer peripheral surface with a series of steps 70 formed therein. Each step 70 is formed as an independent cam surface and offset at a different radial distance from axis C. Each step 70 is separated from an adjacent step 70 by an intermediate surface, and corresponds to a different splay angle of the speaker assembly 22. A step 70 of the cam 68 engages a rear link 58 of a lower speaker assembly (shown in FIGS. 3 and 4) for setting a splay angle between the speaker assemblies 22 corresponding to the step 70.

FIGS. 3 and 4 illustrate the assembly of two speaker assemblies 22 to each other. The rigging system 20 for each speaker assembly 22 includes a pair of frames: a right frame 46 which is mounted to the right side surface 40, and a left frame 46' which is mounted to a left side surface 40'. The left frame 46' is generally symmetrical to the right frame 46 about a vertical axis (not shown).

FIG. 3 illustrates an upper speaker assembly 22 having a rigging system 20 oriented in a stowed position, and a lower speaker assembly 22 having right front and rear links 48, 58 oriented in deployed positions 52, 62; and left front and rear links 48', 58' oriented in deployed positions 52', 62'.

With reference to FIG. 4, the frame 46 includes a first plate 72 and a second plate 74 that are laterally spaced apart from each other. The frame 46 includes a plurality of blocks 76 that are mounted between the plates 72, 74 for maintaining the lateral spacing. Some blocks 76 include longitudinally extending apertures for receiving fasteners (e.g., the plungers 56 and 66). A series of blocks 76 are mounted between a lower front portion of the plates 72, 74 and oriented to form a front vertically extending channel 78 for receiving the front link 48 when it is oriented in the deployed position 52, as shown in FIG. 4. At least two of the blocks 76 include apertures for receiving a front pin 80. The front link 48 includes a longitudinally extending aperture 81 (shown in FIG. 3) that aligns with the apertures of the blocks for receiving the pin 80 and connecting the front ends of the two adjacent speaker assemblies 22 together. As illustrated by the lower speaker assembly 22 of FIG. 4, the front pin 80 may also be stored within the blocks 76 when it is not being used to connect the speaker assemblies 22.

A series of blocks 76 are also mounted between a lower rear portion of the plates 72, 74 and longitudinally spaced apart from each other to form a rear vertically extending channel 84 for receiving the rear link 58 when it is oriented in the deployed position 62, as shown in FIG. 4. At least two of the blocks 76 include apertures for receiving a rear pin 86. The rear link 58 includes a slot 82 that aligns with the apertures of the blocks 76 for receiving the rear pin 86 and connecting the rear ends of the two adjacent speaker assemblies 22 together. As illustrated by the lower speaker assembly 22 of FIG. 4, the rear pin 86 may also be stored within the blocks 76 when it is not being used to connect the speaker assemblies 22.

The cam 68 includes a pair of laterally spaced apart cam plates 88 according to the illustrated embodiment. The plates 88 each include a series of apertures 90 that angularly align with the series of steps 70 such that an aperture 90 is oriented radially inward of each step 70. Each rear link 58 includes an aperture 92 (shown in FIG. 3) that projects laterally through a distal end. The aperture 92 aligns with one of the apertures 90 of the cam 68, for receiving a lock pin 94 and connecting the rear link 58 to the cam 68 of a vertically adjacent speaker assembly 22 to lock a splay angle (as shown in FIG. 8).

Figure 5:
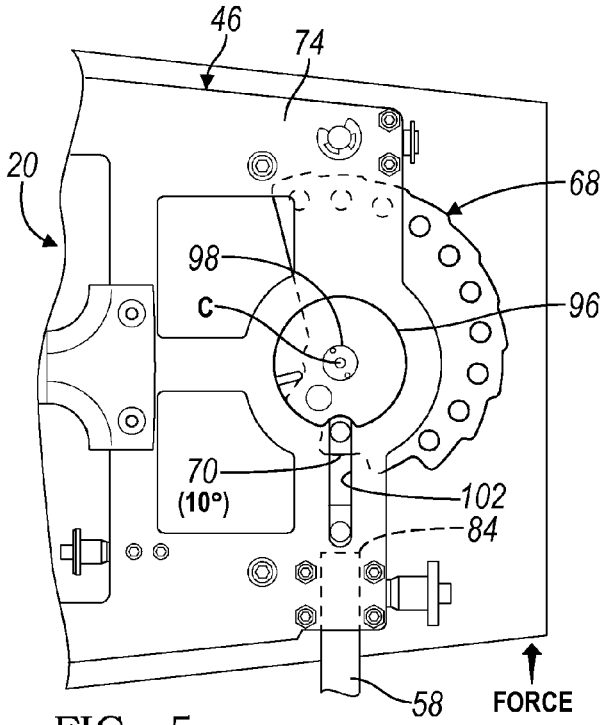
FIG. 5 is a fragmented side view of the speaker assembly of FIG. 2, illustrated with a cam oriented at a position corresponding to a first splay angle.
Figure 7:
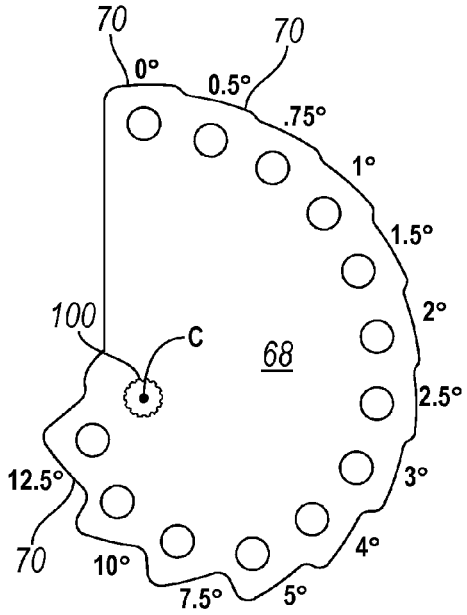
FIG. 7 is an enlarged side view of the cam of FIGS. 5 and 6, and illustrating a splay angle range.
Figure 6:
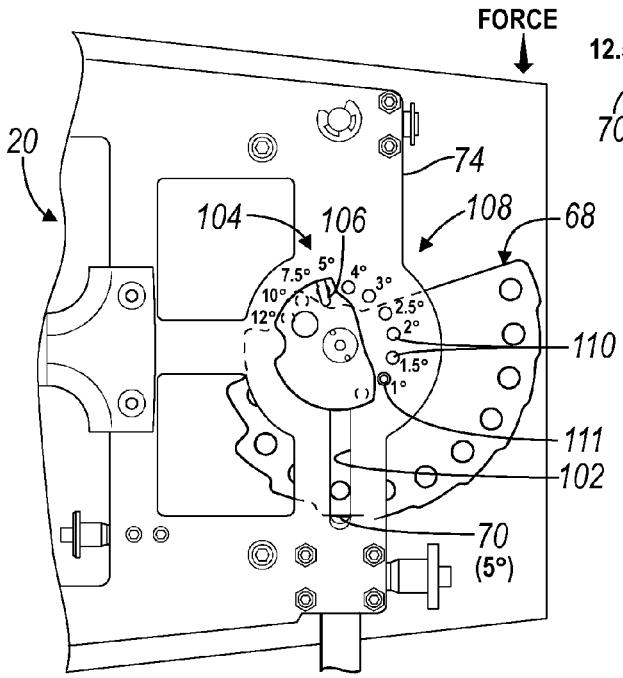
FIG. 6 is another fragmented side view of the speaker assembly of FIG. 2, illustrated with the cam oriented at a position corresponding to a second splay angle.

With reference to FIGS. 5-7, the cam 68 provides a large splay angle range in a compact package, as compared to existing adjustment mechanisms that include shafts with a plurality of holes that correspond to different splay angles. Additionally, the cam 68 allows for small angle increments (e.g., 0.25°).

The rigging system 20 includes a handle 96 for manually adjusting the splay angle, according to one or more embodiments. The handle 96 is oriented laterally outward of the second plate 74 of the frame 46. The frame 46 includes a shaft 98 that is aligned along axis C and rotates relative to the frame 46. The handle 96 includes a central aperture for receiving the shaft 98. The cam 68 includes a pivot aperture 100 for receiving the shaft 98. In one or more embodiments the central aperture of the handle 96 and the pivot aperture 100 are contoured (e.g., splined) for engaging an outer surface of the shaft 98, such that a user rotates the cam 68 by rotating the handle 96. Other embodiments of the rigging system 20 are contemplated that do not include the handle, whereby the cam is adjusted by applying a force to the cam itself (not shown).

Figure 8:
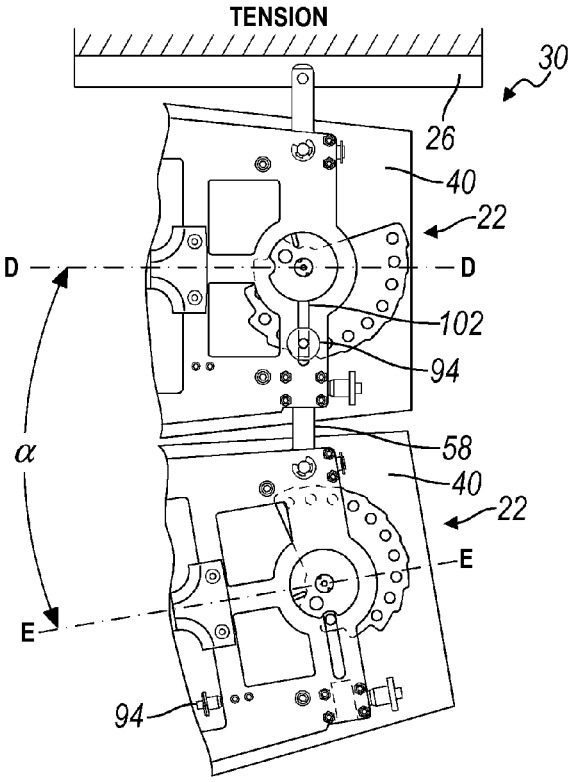
FIG. 8 is a side schematic view of the speaker assemblies of FIG. 5, illustrated in a tension configuration and oriented at a first splay angle.

By rotating the handle 96, a user may select a splay angle between the speaker assembly 22 and a lower speaker assembly 22 (shown in FIG. 8). Each step 70 on the cam 68 is offset from the pivot aperture 100 by a different radial distance, which corresponds to a different splay angle. The cam 68 of the illustrated embodiment provides an adjustable splay angle range of between 0° and 12.5°. The frame 46 includes a slot 102 which extends vertically upward from the channel 84 (shown in FIG. 5). To adjust the cam 68 to a specific splay angle, a user rotates the cam 68 until the step 70 associated with the desired splay angle is oriented within the slot 102. For example, the cam 68 illustrated in FIG. 5 is rotated (counter-clockwise) about axis C, such that the step 70 associated with the 10° splay angle is oriented within the slot 102. The rear link 58 extends through channel 84 to engage the step 70.

With reference to FIG. 6, the rigging system 20 includes a visual interface that includes ornamental indicia 104 for assisting the user in selecting a desired splay angle, according to one or more embodiments. In one embodiment, the ornamental indicia 104 is indicative of the splay angle range, and is displayed on the second plate 74, and radially outward of the handle 96. An ornamental indicia indicative of a pointer 106 (such as a marking, or a slot) is formed on the handle 96 such that a user selects a specific splay angle by rotating the handle 96 until the pointer 106 is aligned with the desired splay angle. Other embodiments of the rigging system 20 contemplate a visual interface that is displayed on the cam itself (not shown).

The rigging system 20 includes a feedback mechanism 108 for assisting proper alignment of the cam 68 as it is indexed between the splay angles. The feedback mechanism 108 includes a radial array of detents 110 and a ball plunger 111, according to one or more embodiments. The radial array of detents 110 are formed into an outer surface of the second plate 74. The handle 96 is shown partially fragmented in FIG. 6 to illustrate the detents 110. The detents 110 are spaced corresponding to the steps 70 of the cam 68. The ball plunger 111 is secured to an inner surface of the handle 96. The ball plunger 111 is spring biased to engage the detents 110 as the handle 96 is rotated to provide positive tactile feedback to the user as the cam 68 is rotated and indexed between the steps 70. In other embodiments, the detents are formed in the handle 96 and the ball plunger is provided in the second plate 74 (not shown).

The slot 82 formed in the rear link 58 (shown in FIG. 4) allows a user to adjust a splay angle without disconnecting the two speaker assemblies 22. As depicted in FIG. 5, a user may apply an upward force "Force" to the rear end of the speaker assembly 22, which disengages the rear link 58 from the cam 68. The user may then adjust the splay angle, by rotating the handle 96 and cam 68, and then release the force, or apply a downward force to engage a different step 70 of the cam 68 with the rear link 58, as shown in FIG. 6.

FIG. 8 depicts two speaker assemblies 22, each having a longitudinal axis that bisects the side surface 40. The longitudinal axis of the upper speaker assembly 22 is denoted as axis "D", and the longitudinal axis of the lower speaker assembly 22 is denoted as axis "E", for illustrative purposes. A splay angle ($\alpha$) is the angle between axis D and axis E, and is adjusted to control the sound projected from each speaker assembly 22. The speaker assemblies 22 of FIG. 8 are oriented at a first splay angle ($\alpha$) of 3°. The speaker assemblies 22 are arranged in the tension configuration 30, where the base 26 is connected to an upper structure.

Figure 9:
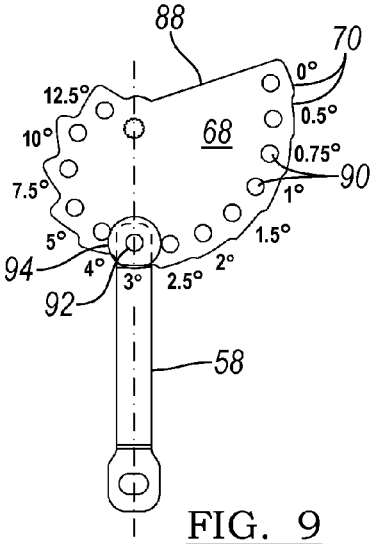
FIG. 9 is an enlarged partial view of the speaker assemblies of FIG. 8, illustrating the cam of the upper speaker assembly and a rear link of the lower speaker assembly.

FIG. 9 is an enlarged view of the cam 68 of the upper speaker assembly 22 and the rear link 58 of the lower speaker assembly 22. The cam 68 is rotated such that the step 70 corresponding to 3° is located within the slot 102, and the rear link 58 engages the step 70. The distal end of the rear link 58 extends between the two cam plates 88 such that the aperture 92 of the rear link 58 aligns with the corresponding aperture 90 of the cam 68. When the speaker assemblies 22 are oriented in such a tension configuration 30, the lock pin 94 is inserted through the aperture 92 and aperture 90 to connect the cam 68 and the rear link 58, and both the cam 68 and the rear link 58 are subjected to tensile loads due to the weight of the lower speaker assembly 22 (FIG. 8).

Figure 10:
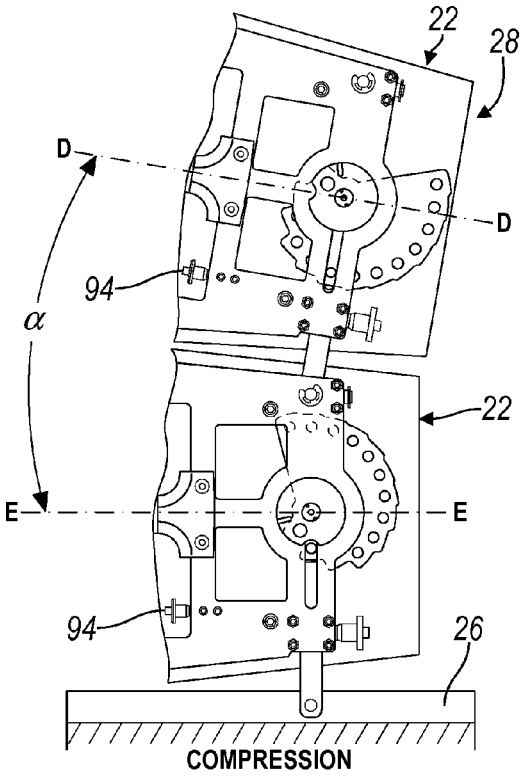
FIG. 10 is a side schematic view of the speaker assemblies of FIG. 5, illustrated in a compression configuration and oriented at the first splay angle.

FIG. 10 depicts two speaker assemblies 22 that are oriented at a splay angle ($\alpha$) of 3°, and arranged in the compression configuration 28, where the base 26 rests upon an underlying surface. When the speaker assemblies 22 are oriented in the compression configuration 28, the lock pin 94 is not needed because the weight of the speaker assemblies 22 maintains the splay angle ($\alpha$), both the cam 68 and the rear link 58 are subjected to compressive loads due to the weight of the upper speaker assembly 22. The lock pin 94 may be stored within an intermediate portion of the frame 46 when not in use.

Figure 11:
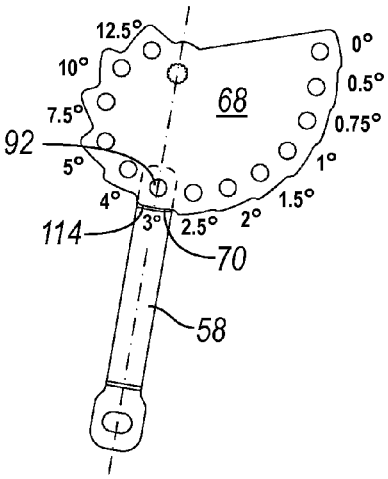
FIG. 11 is an enlarged partial view of the speaker assemblies of FIG. 10, illustrating the cam of the upper speaker assembly and the rear link of the lower speaker assembly of FIG. 10.

Referring to FIGS. 10 and 11, the distal end of the rear link 58 includes a shoulder 114 and an end portion that extends from the shoulder 114. The end portion is formed with a smaller lateral thickness than the shoulder 114, such that the end portion extends between the plates 88 (shown in FIG. 4). The aperture 92 is formed through the end portion and is offset from the shoulder 114, according to one or more embodiments. The shoulder 114 provides an abutment or contact surface for engaging the cam surface of the step 70 for supporting the load of the upper speaker assembly 22 when the speaker assemblies 22 are arranged in the compression configuration 28. In one embodiment, the shoulder 114 is formed with a curved or concave contact surface. The shoulder 114/step 70 interface provides a bearing surface with a surface contact area. The greater the bearing surface area, the greater the load capacity of the rigging system 20.

Figure 13:
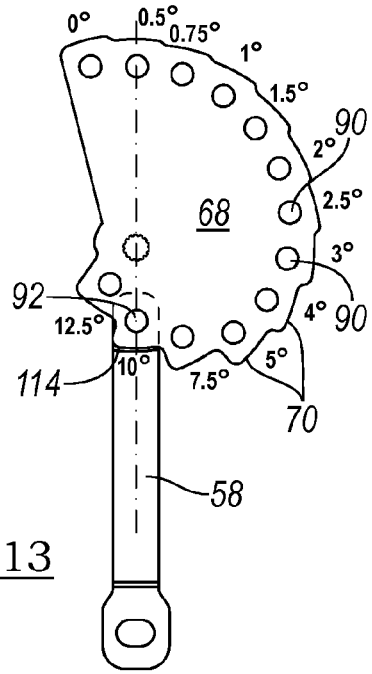
FIG. 13 is an enlarged partial view of the speaker assemblies of FIG. 12, illustrating the cam of the upper speaker assembly and the rear link of the lower speaker assembly.
Figure 12:
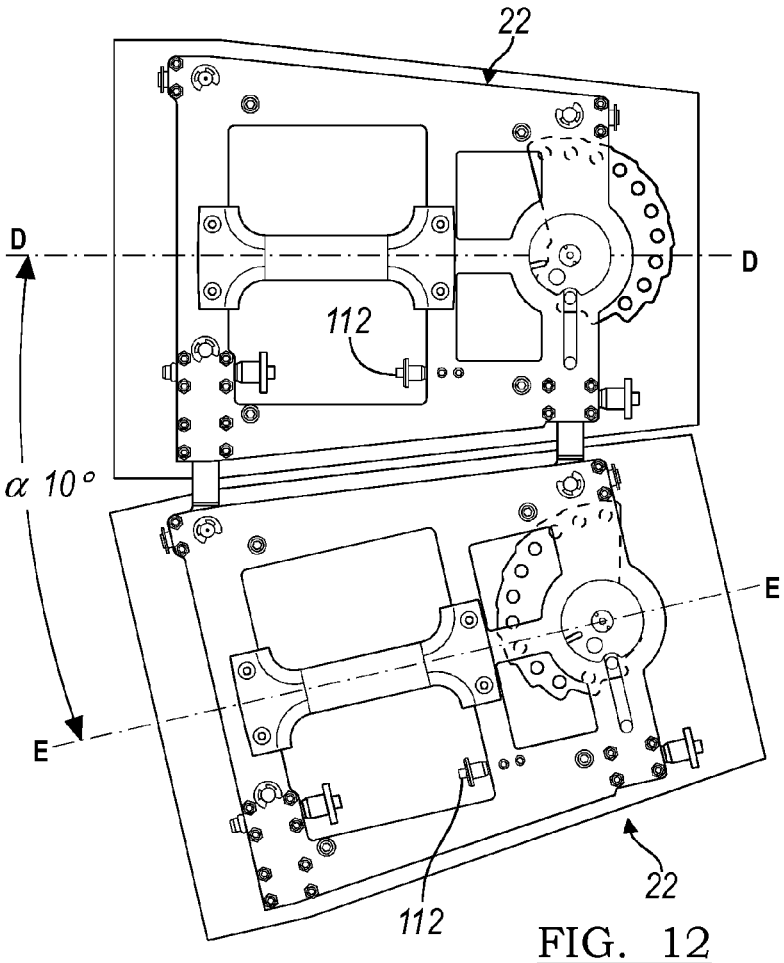
FIG. 12 is a side schematic view of the speaker assemblies of FIG. 5, illustrated oriented at a second splay angle.

FIG. 12 depicts two speaker assemblies 22 that are oriented at a splay angle ($\alpha$) of 10°. FIG. 13 illustrates the arrangement of the cam 68 and the rear link 58 to provide the 10° splay angle.

Figure 14:
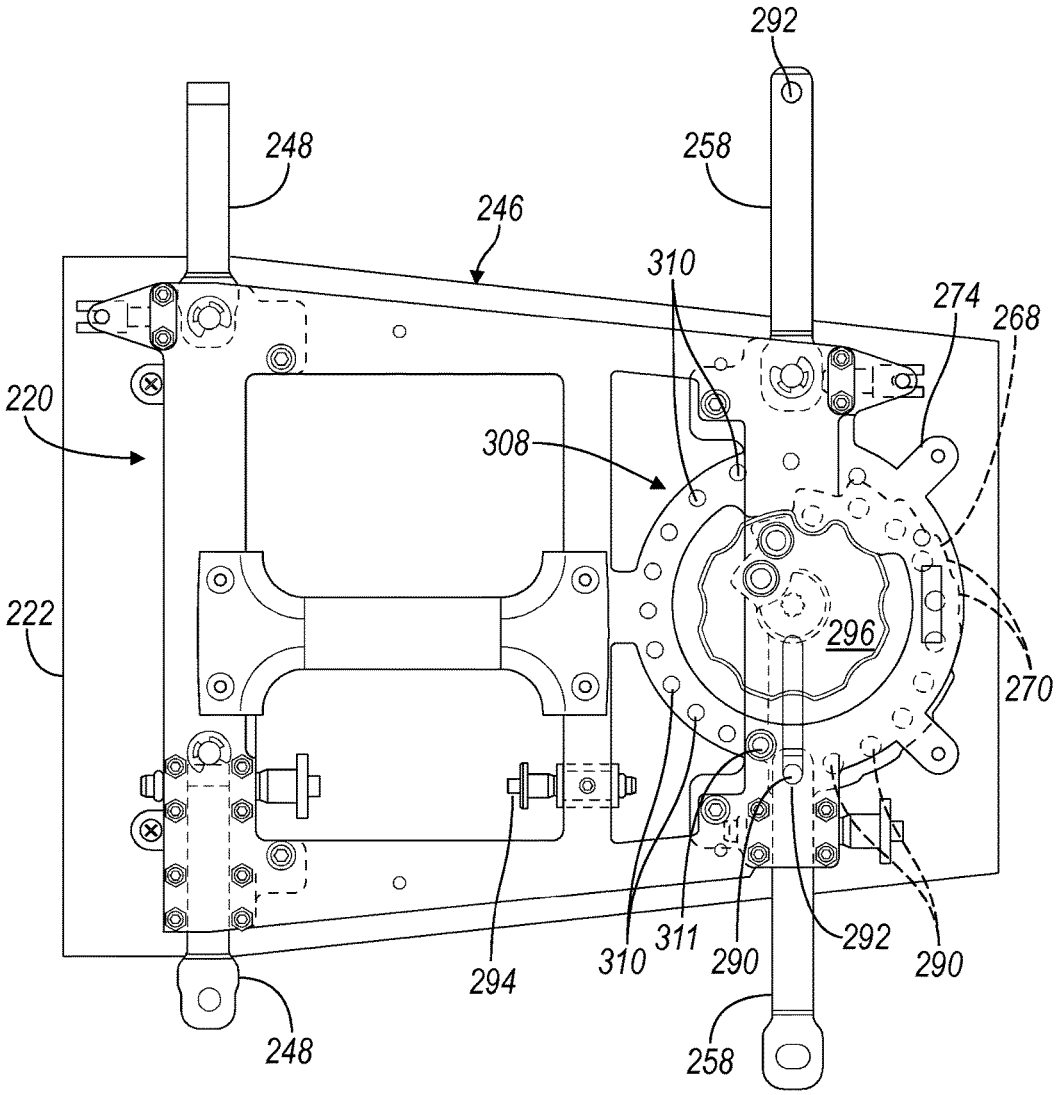
FIG. 14 is an enlarged side view of a speaker assembly according to another embodiment, and illustrated with a portion of a rigging system of a lower speaker assembly.

With reference to FIG. 14, a rigging system is illustrated in accordance with another embodiment and is generally represented by numeral 220. The rigging system 220 is mounted to each speaker assembly 222. The rigging system 220 is similar to the rigging system 20 described with reference to FIGS. 1-13, with the exception of the feedback mechanism and the interface between the cam and the rear link.

The rigging system 220 includes a frame 246, and a front link 248 that is pivotally connected to an upper portion of a front end of the frame 246. The front link 248 pivots between a stowed position (not shown) and a deployed position. The rigging system 220 also includes a rear link 258 that is pivotally connected to an upper portion of a rear end of the frame 246. The front link 248 and the rear link 258 each extend upward from the frame 246 when oriented in the deployed positions for connecting to a lower portion of the frame 246 of a vertically adjacent speaker assembly (not shown).

The rigging system 220 includes a cam 268 for adjusting a splay angle between two vertically adjacent speaker assemblies 222. The cam 268 is pivotally connected to an intermediate portion of the frame 246. The cam 268 has an outer peripheral surface with a series of steps 270 formed therein. Each step 270 is formed as an independent cam surface and offset at a different radial distance from the pivot point. Each step 270 corresponds to a different splay angle of the speaker assembly 222. A step 270 of the cam 268 engages the rear link 258 of a lower speaker assembly (not shown) for setting a splay angle between the speaker assemblies 222.

The cam 268 includes a series of apertures 290 that align angularly with the series of steps 270 such that an aperture 290 is oriented radially inward of each step 270. Each rear link 258 includes an aperture 292 that projects laterally through a distal end. The aperture 292 aligns with one of the apertures 290 for receiving a lock pin 294 and connecting the rear link 258 to the cam 268 of a vertically adjacent speaker assembly 222 to lock a splay angle.

The rigging system 220 includes a handle 296 for manually adjusting of the splay angle. The handle 296 is oriented laterally outward of a second plate 274 of the frame 246. The handle 296 and the cam 268 are connected to a common shaft such that a user rotates the cam 268 by rotating the handle 296. Other embodiments of the rigging system 20 are contemplated that do not include the handle, whereby the cam is adjusted by applying a force to the cam itself (not shown).

The rigging system 220 includes a feedback mechanism 308 for assisting proper alignment of the cam 268 at each splay angle. A radial array of detents 310 are formed into the second plate 274, according to the illustrated embodiment. The detents 310 are spaced corresponding to the steps 270 of the cam 268. A ball plunger 311 is provided on an inner surface of the cam 268. The ball engages the detents 310 as the handle 296 is rotated to align the cam 268 as it is indexed between different splay angle settings.

Figure 15:
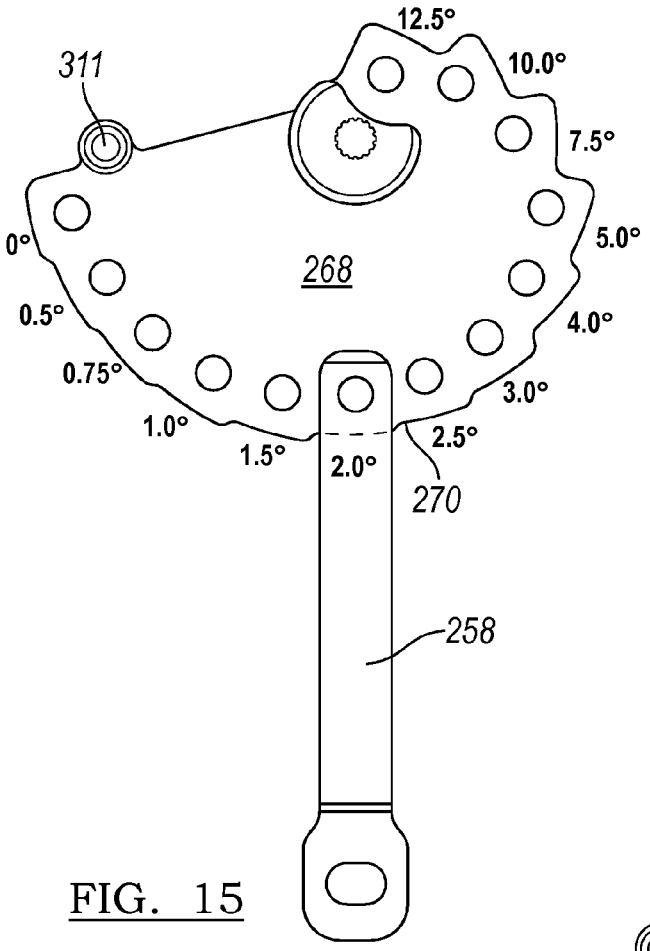
FIG. 15 is an enlarged side view of a cam of the upper speaker assembly and a rear link of the lower speaker assembly of FIG. 14, and illustrated oriented at a position corresponding to a first splay angle.
Figure 16:
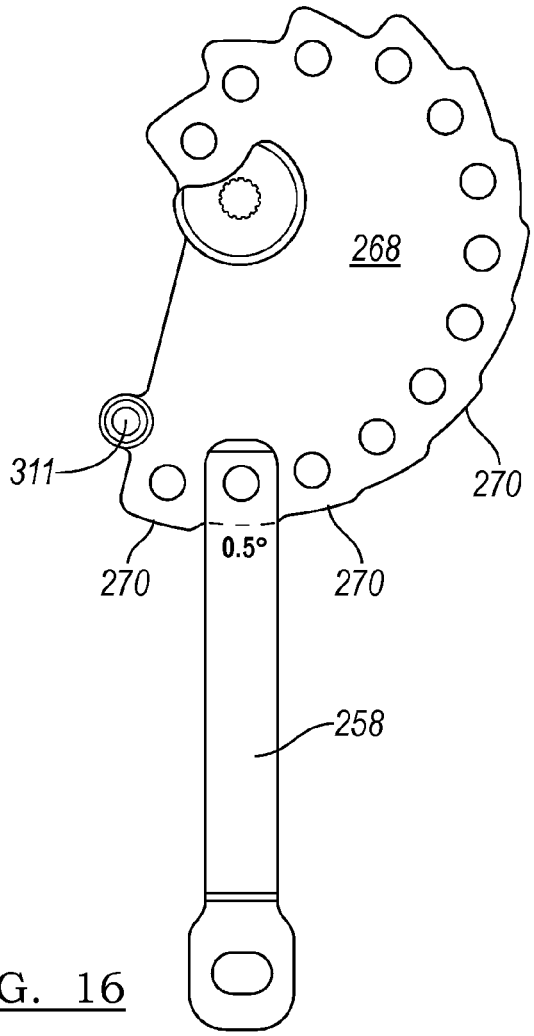
FIG. 16 is another enlarged side view of the cam of the upper speaker assembly and the rear link of the lower speaker assembly of FIG. 14, and illustrated oriented at a position corresponding to a second splay angle.

Referring to FIGS. 15 and 16, each step 270 of the cam 268 corresponds to a different splay angle. The cam 268 of the illustrated embodiment provides an adjustable splay angle range of between 0° and 12.5°. FIG. 15 depicts the rear link 258 connected to the step 270 corresponding to a 2° splay angle, and FIG. 16 depicts the rear link 258 connected to the step 270 corresponding to a 0.5° splay angle. In one or more embodiments, the rigging system 220 includes the visual interface described above with reference to FIG. 6.

Figure 17:
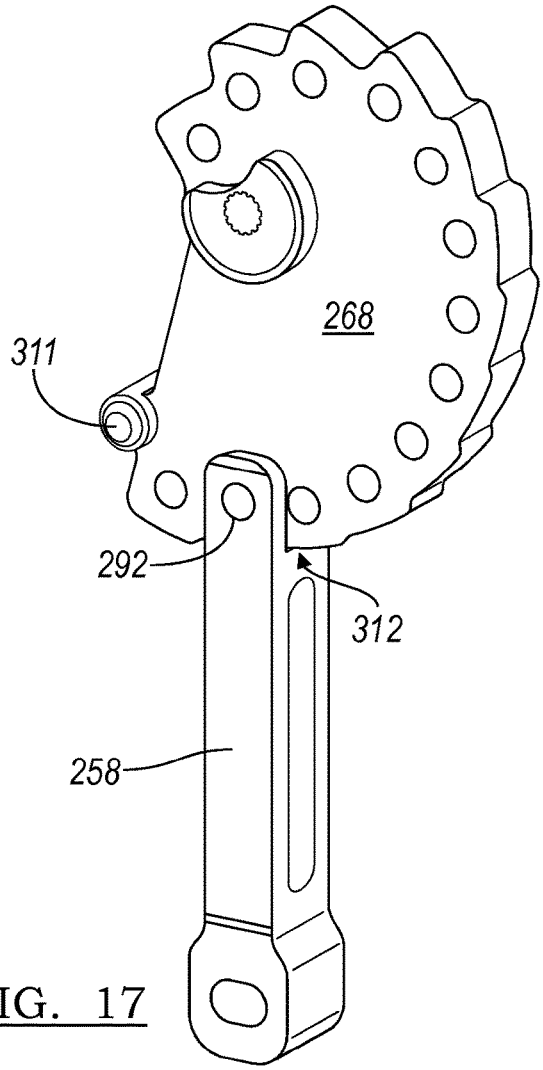
FIG. 17 is a rear perspective view of the cam and rear link of FIG. 16.
Figure 18:
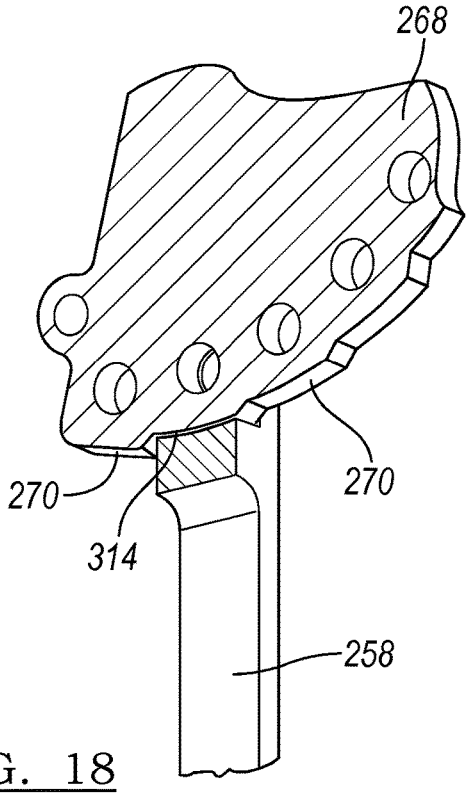
FIG. 18 is a partial section view of the cam and rear link of FIG. 17.

With reference to FIGS. 17 and 18, the cam 268 is formed as a single plate, according to one or more embodiments. The rear link 258 includes a distal end with a pair of laterally spaced apart end portions that define a channel 312. The rear link 258 includes a shoulder 314 within the channel 312 that is offset from the aperture 292, according to one or more embodiments. The shoulder 314 provides an abutment or contact surface for engaging the cam surface of the step 270 for supporting the load of the upper speaker assembly 222 when the speaker assemblies 222 are arranged in a compression configuration. In one embodiment, the shoulder 314 is formed with a curved or concave contact surface. The shoulder 314/step 270 interface provides a bearing surface with a surface contact area. The greater the bearing surface area, the greater the load capacity of the rigging system 220.

Thus, the rigging system 20, 220 provides a cam 68, 268 having a series of steps 70, 270 formed as independent cam surfaces, where each step corresponds to a different splay angle. Such a cam 68, 268 provides a large splay angle range in a compact package, and allows for small splay angle increments (e.g., 0.25°). Further, when used in a compression configuration, the steps 70, 270 engage a corresponding shoulder formed in the rear link 58, 258 for distributing the weight of the speaker assemblies 22, 222 over a large bearing surface without a fastener.

Although the rigging system 20, 220 is described as having a rear link that extends upward from a lower speaker assembly to engage a cam of an upper speaker assembly; other embodiments of the rigging system are contemplated in which the rear link extends downward from an upper speaker assembly to engage the cam of a lower speaker assembly (not shown).

In one or more embodiments, a rigging system is provided for connecting a pair of speaker assemblies in a vertical line array. The rigging system includes a frame that is mounted to a side surface of a speaker cabinet. The rigging system also includes a cam and a rear link. The cam is pivotally connected to an intermediate portion of the frame about a pivot point. The cam has an outer peripheral surface with at least two steps formed therein. Each step is formed with an independent cam surface and offset at a different radial distance from the pivot point corresponding to a splay angle of the speaker cabinet. The rear link is pivotally connected to an upper portion of the frame with a distal end having a contact surface formed therein for engaging the independent cam surface of one of the steps for setting a splay angle corresponding to the step.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. Additionally, the features of various implementing embodiments may be combined to form further embodiments of the disclosure.

What is claimed is:

1. A speaker rigging assembly comprising:

a frame;

a cam pivotally connected to the frame about a pivot point, with at least two cam surfaces, each of the at least two cam surfaces being offset at a different radial distance from the pivot point corresponding to a splay angle, with an intermediate surface between the at least two cam surfaces; and a unitary link having an elongate shape with a proximal end pivotally connected to an upper rear portion of the frame and a distal end having a contact surface, wherein the distal end of the unitary link extends from the frame in a deployed position and the contact surface engages a cam surface of a cam of an adjacent speaker rigging assembly;

wherein at least one of the frame and the unitary link are adapted to be mounted to a speaker assembly.

2. The speaker rigging assembly of claim 1 wherein the link engages the cam and maintains the splay angle therebetween without a fastener during compressive loading.

3. A speaker array comprising:

a first speaker rigging assembly according to claim 1; and a second speaker rigging assembly according to claim 1;

wherein the link of the second speaker rigging assembly engages the cam of the first speaker rigging assembly and maintains the splay angle therebetween without a fastener during compressive loading; and wherein the splay angle comprises an angle between a first longitudinal axis that bisects the frame of the first speaker rigging assembly and a second longitudinal axis that bisects the frame of the second speaker rigging assembly.

4. The speaker rigging assembly of claim 1 wherein the cam further comprises a pair of laterally spaced apart plates that collectively define the at least two cam surfaces; and wherein the distal end of the link further comprises an end portion that extends from a shoulder, the end portion having a smaller lateral thickness than the shoulder such that the end portion extends between the pair of laterally spaced apart plates, and the shoulder provides the contact surface to engage the cam surface.

5. The speaker rigging assembly of claim 1 wherein the distal end of the link comprises a pair of laterally spaced apart end portions that define a channel for receiving the at least two cam surfaces, and wherein the contact surface is formed within the channel to engage the cam surface.

6. The speaker rigging assembly of claim 1 wherein the cam further comprises at least two apertures formed therethrough, each cam aperture being angularly aligned with one of the cam surfaces, and wherein the distal end of the link further comprises an aperture formed therethrough; and wherein the link aperture of the speaker assembly is aligned with one of the cam apertures to receive a fastener and maintain the splay angle during tensile loading.

7. The speaker rigging assembly of claim 1 wherein the frame comprises:

a first plate; and a second plate laterally spaced apart from the first plate, the first plate being adapted to mount to a side surface of a speaker cabinet;

wherein the cam is disposed between the first plate and the second plate.

8. The speaker rigging assembly of claim 7 further comprising:

a shaft aligned with the pivot point and mounted for rotation relative to the frame, the shaft having a first end connected to the cam; and a handle connected to a second end of the shaft, wherein the cam pivots about the pivot point in response to rotation of the handle.

9. The speaker rigging assembly of claim 8 wherein the second plate is provided with an outer surface with an array of detents formed therein and spaced about the pivot point, and wherein the handle is laterally spaced apart from the second plate; and wherein the speaker rigging assembly further comprises:

a spring biased element secured to an inner surface of the handle and adapted to engage each of the array of detents as the handle is rotated to provide tactile feedback to a user corresponding to the position of the cam.

10. The speaker rigging assembly of claim 8 further comprising:

ornamental indicia indicative of a range of splay angle values associated with the at least two cam surfaces disposed on one of the frame and the handle; and ornamental indicia indicative of a pointer disposed on the other of the frame and handle to align with the range of splay angle values.

11. A speaker array comprising:

a first speaker assembly with a first speaker cabinet having laterally spaced apart first side surfaces;

a first frame mounted to one of the first side surfaces;

a first cam pivotally connected to the first frame about a first pivot point;

a first link formed unitary, with a first proximal end pivotally connected to the first frame and a first distal end having a first contact surface formed therein;

a second speaker assembly with a second speaker cabinet having laterally spaced apart second side surfaces;

a second frame mounted to one of the second side surfaces;

a second cam pivotally connected to the second frame about a second pivot point, wherein the second cam has at least two steps formed into a peripheral surface, each step being formed with an independent cam surface that is offset at a different radial distance from the second pivot point corresponding to a splay angle; and a second link formed unitary, with a second proximal end pivotally connected to the second frame and a second distal end having a second contact surface formed therein;

wherein the first link extends from the first frame in a deployed position such that the first contact surface engages one of the steps of the second speaker assembly for orientating the first speaker assembly and the second speaker assembly at a splay angle therebetween corresponding to the step.

12. The speaker array of claim 11 wherein the proximal end of the first link is pivotally connected to an upper rear portion of the first frame and extends upward therefrom to engage one of the steps of the second speaker assembly.

13. The speaker array of claim 12 further comprising a first front link having a first front proximal end pivotally connected to an upper front portion of the first frame and a first front distal end for connecting to a lower front portion of the second speaker assembly.

14. The speaker array of claim 11 wherein the first link of the first speaker assembly engages one of the steps of the second speaker assembly and maintains the splay angle therebetween without a fastener during compressive loading.

15. A speaker assembly rigging system comprising:

a first frame;

a second frame adapted to couple to the first frame;

a cam pivotally connected to the first frame about a pivot point, with at least two cam surfaces, each of the at least two cam surfaces being offset at a different radial distance from the pivot point corresponding to a splay angle; and a unitary link having a proximal end pivotally connected to the second frame and a distal end having a contact surface, wherein the unitary link extends from the second frame in a deployed position such that the contact surface engages one of the cam surfaces.

16. The speaker assembly rigging system of claim 15 wherein the link engages the cam and maintains the splay angle therebetween without a fastener during compressive loading.

17. The speaker assembly rigging system of claim 15 wherein the frame comprises:

a first plate; and a second plate laterally spaced apart from the first plate, the first plate being adapted to mount to a side surface of a speaker cabinet;

wherein the cam is disposed between the first plate and the second plate.

18. The speaker assembly rigging system of claim 17 further comprising:

a shaft aligned with the pivot point and mounted for rotation relative to the frame, the shaft having a first end connected to the cam; and a handle connected to a second end of the shaft, wherein the cam pivots about the pivot point in response to rotation of the handle.

19. The speaker assembly rigging system of claim 18 wherein the second plate is provided with an outer surface with an array of detents formed therein about the pivot point, and wherein the handle is laterally spaced apart from the second plate; and wherein the rigging system further comprises:

a spring biased element secured to an inner surface of the handle and adapted to engage each of the array of detents as the handle is rotated to provide tactile feedback to a user corresponding to the position of the cam.

20. The speaker assembly rigging system of claim 18 further comprising:

ornamental indicia indicative of a range of splay angle values associated with the at least two cam surfaces disposed on one of the frame and the handle; and ornamental indicia indicative of a pointer disposed on the other of the frame and handle to align with the range of splay angle values.

* * * * *